US005436049A

United States Patent [19]

Hu

[11] Patent Number: 5,436,049

[45] Date of Patent: Jul. 25, 1995

[54] PROCESS FOR THE MANUFACTURE OF A STAIN RESISTANT CARPET

[75] Inventor: Harry Y. Hu, Arden, N.C.

[73] Assignee: BASF Corporation, Mt. Olive, N.J.

[21] Appl. No.: 171,135

[22] Filed: Dec. 21, 1993

[51] Int. Cl.[6] ..... C08L 77/02; C08L 61/04; C08L 33/10

[52] U.S. Cl. ..... 428/85; 428/96; 525/419; 525/480; 525/502; 525/505; 525/508

[58] Field of Search ..... 428/85, 96, 451; 525/502, 505, 508, 480, 419

[56] References Cited

U.S. PATENT DOCUMENTS 4,822,373 4/1989 Olson et al. ..... 8/115.6
4,940,757 7/1990 Moss et al. ..... 525/502
5,238,982 8/1993 Adhya et al. ..... 524/145

*Primary Examiner*—W. Robinson Clark
*Attorney, Agent, or Firm*—Nixon & Vanderhye

[57] ABSTRACT

A process for the manufacture of a stain resistant carpet by melt mixing a fiber forming synthetic polyamide with a compound, being capable to react with an amino group, to form a homogeneous polymer melt into fibers, tufting the fibers into a backing to form a carpet and treating the carpet with polymethacrylic acid, copolymers of polymethacrylic acid, a mixture of polymethacrylic acid and a sulfonated aromatic formaldehyde condensation product, and a reaction product of the polymerization or copolymerization of methacrylic acid in the presence of a sulfonated aromatic formaldehyde condensation product.

20 Claims, No Drawings

PROCESS FOR THE MANUFACTURE OF A STAIN RESISTANT CARPET

FIELD OF THE INVENTION

The present invention relates to a process for the manufacture of a stain resistant carpet, more specifically, it relates to the treatment of a nylon carpet having a low content of amino end groups in the nylon with a polymethacrylic acid, copolymers of polymethacrylic acid, a mixture of polymethacrylic acid and a sulfonated aromatic formaldehyde condensation product and a reaction product of the polymerization or copolymerization of methacrylic acid in the presence of a sulfonated aromatic formaldehyde condensation product.

BACKGROUND OF THE INVENTION

Stain resistant carpet fibers are manufactured by treating nylon fibers with stain protectors.

U.S. Pat. No. 4,822,373 discloses a fibrous polyamide substrate, which has resistance to staining by acid colorants by treatment with a partially sulfonated novolak resin and polymethacrylic acid, copolymers of methacrylic acid, or combination of polymethacrylic acid and copolymers of methacrylic acid.

U.S. Pat. No. 4,940,757 discloses a stain resistant composition, prepared by polymerizing a $\alpha$-substituted acrylic acid in the presence of a sulfonated aromatic formaldehyde condensation polymer.

Disadvantage of the stain resistant fibers described above is, that after a treatment with a high pH shampoo, the stain protection of the fibers, treated with stain protectors is almost disappeared.

Object of the present invention was, to provide a process for the manufacture of stain resistant carpet fibers, which keep a high degree of stain protection even after several treatments with a high pH shampoo.

SUMMARY OF THE INVENTION

The object of the present invention was achieved with a process for the manufacture of stain resistant carpet, which comprises:

a) melt mixing a fiber forming synthetic polyamide with a compound, being capable of reacting with amino end groups of the polyamide so as to reduce the amino end group (AEG) content thereof, to form a homogeneous polymer melt;

b) spinning the polymer melt into fibers;

c) tufting the fibers into a backing to form a carpet; and d) treating the carpet with a compound, selected from the group consisting of polymethacrylic acid, copolymers of polymethacrylic acid, a mixture of polymethacrylic acid and a sulfonated aromatic formaldehyde condensation product and a reaction product of the polymerization or copolymerization of methacrylic acid in the presence of a sulfonated aromatic formaldehyde condensation product.

DESCRIPTION of THE PREFERRED EMBODIMENTS

In step (a) of the process for the manufacture of stain resistant carpet fibers, a fiber forming synthetic polyamide is melt mixed with a compound, being capable to react with an amino group, to form a homogeneous polymer melt. Suitable synthetic polyamides hereinafter referred to as nylons are nylon 6, nylon 6/6, nylon 6/9, nylon 6/10, nylon 6T, nylon 6/12, nylon 11, nylon 12 and copolymers thereof or mixtures thereof. Suitable polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-$\epsilon$-caprolactam (nylon 6) and polyhexamethylene adipamide (nylon 6/6). Most preferred is nylon 6.

Suitable compounds, which are capable to react with an amino group of the polyamide are lactams, carboxylic acids (e.g., $\alpha,\beta$-unsaturated carboxylic acids), anhydrides, acid halogenates, lactones, esters and amides and the like.

Suitable lactams are for example acetylcaprolactam and adipoyldicaprolactam.

Suitable carboxylic acids are for example benzoic acid, maleic acid, succinic acid, adipinic acid, terephthalic acid, isophthalic acid, acetic acid and propionic acid.

Suitable anhydrides are for example, maleic anhydride, propionic anhydride, succinic anhydride and benzoic anhydride.

A suitable acid halogenate is benzoic chloride.

Suitable lactones are epsilon-caprolactone, butyrolactone and cumarin.

Suitable $\alpha,\beta$-unsaturated acids, esters and amides are acrylic acid, methacrylic acid, $C_1$–$C_{18}$ alkyl acrylates and methacrylates like methyl acrylate, ethyl acrylate and methacrylate, propyl acrylate and methacrylate and butyl acrylate and methacrylate, acrylamide and methacrylamide.

Preferred compounds in step (a) are adipoyldicaprolactam, maleic anhydride and epsilon-caprolactone.

The compound in step (a) is used in an amount of from about 0.5 to about 5% by weight, preferably from about 1 to about 4% by weight, most preferred from about 1.5 to about 3% by weight, based on the total amount of the polyamide fiber.

The melt mixing is usually performed in an extruder at a temperature of from about 225° to 400° C. in accordance with the melting point of the respective nylon.

At this point additives in effective amounts may be added to the polymer. Suitable additives are fillers, flame retardants, UV-light stabilizers, antioxidants, pigments, dyes, antistatic agents, antimicrobial agents, nucleating agents and the like.

Suitable pigments for melt coloring of the nylon are for example an inorganic pigment like Sicotrans® Red L2915 from BASF (C. I. Pigm. Red 101), a phthalocyanine copper complex like Monolite TM Blue FBG from ICI (C. I. a perylene like Paliogen® RedL3880 from BASF (C. I. Pigm Red 178).

The homogeneous polymer melt is spun through a spinnerette into fibers, which have an amine end group content of lower than about 30 meg/kg, preferably lower than about 20 meg/kg and most preferred lower than about 15 meg/kg.

If the melt is not melt colored by pigments, the fibers may be dyed in an additional step. Suitable dyes are acid dyes, disperse dyes, premetalized dyes and cationic dyes.

Examples for acid dyes are an anthraquinone like Tectilon® Blue 4R 200 N from Ciba (C. I. Acid 277), a diazo dye like Tectilon® Orange 3G from Ciba (C. I. Acid Orange 156), a monoazo dye like Tectilon® Red 2B 200 N from Ciba (C. I. Acid Red 361) and a monoazo dye like Tectilon ® Yellow 2G 200 from Ciba (C. I. Acid Yellow 169), and an anthraquinone like Telon ® Blue GRL from Mobay (C. I. Acid Blue 324).

Examples for disperse dyes are a nitrodiphenylamine like Terasil ® Yellow E2R from Ciba (C. I. Disperse Yellow 86), an anthraquinone like Terasil ® Brilliant Pink 3G from Ciba (C. I. Disperse Red 302), an anthraquinone like Terasil ® Blue E BLF from Ciba (C. I. Disperse Blue 77), and an anthraquinone like Terasil ® Brilliant Blue BGE from Ciba (C. I. Disperse Blue 60).

Examples for premetallized dyes are a monoazo dye (1:2 metal complex) like Irgalan ® Yellow 3RL KWL250 from Ciba (C. I. Acid Orange 162) a monoazo dye (1:2 metal comple) like Irgalan ® Bordeaux EL 200 from Ciba (C. I. Acid Red 251), an azo dye (1:2 metal complex) like Irgalan ® Black RBL 200 from Ciba (C. I. Acid Black 132), and an azo (1:2 metal complex), like Intralan TM Yellow NW from Crompton & Knowles (C. I. Yellow 151).

Examples for cationic dyes are an oxazine, like Sevron TM Blue 5GMF from Crompton & Knowles (C. I. Basic Blue 3), a triarylamine like Sevron*TM* ER 200% from Crompton & Knowles (C. I. Basic Blue 77), a monoazo dye like Sevron ® Red GL from Crompton & Knowles (C. I. Basic Red 18), an anthraquinone like Basacryl ® Blue Liq. 50% from BASF (C. I. Basic Blue 60), an anthraquinone like Basacryl ® Yellow 5RL 300% from BASF (C. I. Basic Violet 25), and a monoazo dye like Basacryl ® Red GL, GL Liq. from BASF (CI. Basic Red 29).

A typical fiber dyeing procedure with for example acid dyes is that samples are dyed at a volume equal to 20 times the weight of the sample. A stock solution is prepared using deionized water with 1–2% (on the weight of fiber) Chemcogen TM AC (anionic levelling agent), 0.5 grams per liter of trisodium phosphate, and 0.25–0.50 grams per liter of Versene TM (Ethylenediaminetetraacetic acid, disodium salt; sequestering agent) from Mallinckrodt Specialty Chemicals Co. in Paris KY and dyestuffs (predisolved). Yarn samples are placed into beakers where they are heated in for example a Launder-Ometer to about 90° to about 100° C. at a rate of from about 1° to about 2° C. per minute and held at about 90° to about 100° C. for about 30 to about 60 minutes. Samples are cooled to about 35° to about 45° C. and removed. Yarns are then rinsed with warm then cold water, extracted, and tumble dried.

The fibers or yarns are manufactured in two different ways. In a two step process the fibers are spun, treated with a finish and wound on a package as a yarn.

In a subsequent step, the yarn is drawn and texturized to form a bulked continuous filament (BCF) yarn suitable for tufting into carpets. A more preferred technique involves combining the extruded or as-spun filaments into a yarn, then drawing, texturizing and winding a package, all in a single step. This one-step method of making BCF is referred to in the trade as spin-draw-texturing.

Nylon filaments for the purpose of carpet manufacturing have deniers (denier + weight in grams of a single filament with a length of 9000 meters) in the range of about 3 to 75 denier/filament (dpf). A more preferred range for carpet fibers is from about 15 to 25 dpf.

From here, the BCF yarns can go through various processing steps well known to those skilled in the art. The fibers of this invention are tufted into a backing to form a carpet.

For the manufacture of a carpet in step (c), the BCF yarns are generally tufted into a pliable primary backing. Primary backing materials are generally selected from the group comprising conventional woven jute, woven polypropylene, cellulosic nonwovens, and nonwovens of nylon, polyester, and polypropylene.

The fibers are treated as spun or after winding up on a package in a separate step with polymethacrylic acid, copolymers of polymethacrylic acid, a mixture of polymethacrylic acid and a sulfonated aromatic formaldehyde condensation product or a reaction product of the polymerization of methacrylic acid in the presence of a sulfonated aromatic formaldehyde condensation product.

Copolymers of polymethacrylic acid are formed by copolymerization of methacrylic acid with one or more comonomers, which is described for example in U.S. Pat. No. 4,822,373, the contents thereof is herewith incorporated by reference.

Preferred comonomers include mono- or polyolefinically unsaturated acids, esters, anhydrides and amides like acrylic acid, maleic acid maleic anhydride, fumaric acid, $C_1$— to $C_{18}$— alkyl or cycloalkylesters of these acids, hydroxyalkyl acrylates and methacrylates, acrylamide, and methacrylamide.

Preferred is acrylic acid, methyl acrylate, ethyl acrylate, 2-hydroxeyethyl methacrylate and 2-hydroxypropylenethaacrylate.

Sulfonated aromatic formaldehyde condensation products are described for example in U.S. Pat. No. 4,940,757, the contents thereof is herewith incorporated by reference.

Suitable compounds are formaldehyde condensation products of formaldehyde with 4,4'-dihydroxydiphenylsulfone or with phenyl—4-sulfonic acid.

Suitable compounds are also reaction products, which are formed when methacrylic acid is polymerized or copolymerized with one or more comonomers in the presence of a sulfonated aromatic formaldehyde condensation product.

The polymethacrylic acid, its copolymers, mixtures and reactions products with sulfonated aromatic formaldehyde condensation products are applied to the fibers in an aqueous solution with a solid content of from about 0.1 to about 5.0% by weight. Preferably from about 0.2 to about 3.0% by weight, most preferred from about 0.5 to about 1.5% by weight.

The unbacked carpet may be treated in step (d) with the aqueous solution of stain protector by any of the known application methods. The preferred application methods are exhaust application, continuous application and foam application. Preferably the unbacked carpet may be treated with stain protector by the foam application method in conjunction with the latex backing operation, described below.

In the exhaust application method, the carpet is treated in an aqueous bath with a carpet bath weight ratio of from about 1:5 to about 1:100, preferably from about 1:10 to about 1:50 for a time period of from about 5 to about 40 minutes, preferably for a time period of 15 to about 20 minutes at a pH of from about 1.5 to about 6.0, preferably at a pH of from about 2.0 to about 3.0 at a temperature of from about 40° to about 90° C., preferably at a temperature of from about 70° to about 85° C. with stain protector in the bath at a concentration of from about 0.1 to about 10.0% by weight of the carpet, preferably of from about 0.2 to about 3.0% by weight. The carpet is removed from the bath, extracted and dried in an oven at a temperature of from about 50° to about 120° C.

In the continuous application, the unbacked carpet is padded through rolls like Flexnip® rolls in a bath, wherein the pick-up of the carpet takes place at a carpet: bath weight ratio of from about 1:1 to about 1:5, preferably from about 1:2 to about 1:3. The stain protector concentration in the pad bath is from about 0.1 to about 10.0% by weight of the carpet, preferably from about 0.2 to about 3.0% and the pH is from about 1.5 to 6.0, preferably from about 2.0 to 3.0.

The carpet, then passes into a steamer where it is steamed at a temperature of 80° to 100° C., preferably at 95° to 100° C. for 0.5 to 6.0 minutes, preferably for 1.0 to 3.0 minutes.

In the foam application, the carpet is passed under a foam applicator and a foam composition of the stain protector with a blow ratio of air: liquid of from about 10:1 to 80:1, preferably from about 40:1 to 60:1 is applied to the surface of the carpet with sufficient force to penetrate to the base of the carpet tufts at a wet pick-up of from about 5 to about 60%, preferably at a wet pick-up of from about 10 to about 30%, based on the weight of the carpet at a pH of from about 2.0 to 6.0, preferably from about 2.0 to 4.0. The concentration of the stain protector in the bath for the foam formation is from about 0.1 to about 10.0% by weight, preferably from about 0.2 to about 3.0%. The carpet is then dried in an oven at a temperature of from about 100° to about 120° C.

To lower the pH of the stain protector bath in all three applications, organic or inorganic acids like p-toluenesulfonic acid, phosphoric acid, sulfonic acid, sulfamic acid and the like are added to the bath. Preferred is sulfamic acid.

The final concentration of the stain protector on the carpet in all three application methods is from about 0.1 to about 5% by weight, based on the weight of the carpet, preferably from about 0.2 to about 3% by weight.

The primary backing is then coated with a suitable latex material such as a conventional styrene-butadiene latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene.

It is preferred to use a woven polypropylene primary backing, a conventional styrene-butadiene (SB) latex formulation, and either a woven jute or woven polypropylene secondary carpet backing. The SB latex can include calcium carbonate filler and/or one or more of the hydrate materials listed above.

The carpets are useful for floor covering applications.

EXAMPLES

The amino end group (AEG) content of nylon-6 in the Examples was determined by using standard titration procedures. The procedure comprised dissolving nylon-6 in 68:32 by volume phenol- methanol solution, titrating the amino end groups to a potentiometric end point using aqueous HCl. Depth of staining is determined by measuring the total color difference of the dry sample (called delta E) as determined under the CIE L*a*b* color system using a daylight 5500 standard illuminate. Further details on CIE L,a,b, measurements and total color difference may be found in *Principles of Color Technology, 2nd Edition* by Fred Billmeyer and Max Saltzman. A unstained yarn served as the standard from which the color difference of stained yarn is determined. A delta E of less than 5 is considered substantially unstained.

EXAMPLE I

Various amounts of epsilon-caprolactone was added to nylon 6 chips (Ultramid® BS700 from BASF AG, RV=2.7 measured as 1% solution in 90% formic acid at 25° C.) and melt mixed in an extruder at a temperature of 270° C., melt spun, finished, drawn and textured into a 1115 denier, 56 filament yarn. A control yarn was prepared using the identical procedure except that no epsilon-caprolactone was utilized. The resulting yarns were tested for relative viscosity (RV) and amino end groups. The results are shown in Table I.

TABLE I

| Test No. | Caprolactone wt % | RV | AEG (meg/Kg) |
|---|---|---|---|
| 1 (control) | 0.0 | 2.80 | 35.5 |
| 2 | 0.8 | 2.83 | 13.4 |
| 3 | 1.0 | 2.81 | 10.5 |
| 4 | 1.2 | 2.81 | 8.5 |
| 5 | 1.5 | 2.78 | 7.1 |
| 6 | 1.8 | 2.78 | 5.6 |

The yarns were knitted into tubes as a simulation for a carpet for dyeing, stain protector treatment, shampooing, and testing. The knitted tubes were dyed with an acid dye. Typical procedures for dyeing, treatments and testing are described below:

Dyeing nylon carpet yarns with acid dyes

Samples are dyed in beakers in an Atlas Lauder-Ometer at a volume equal to 20 times the weight of the sample. A stock solution is prepared using deionized water with 1% Chemcogen® AC (anionic levelling agent from Rhone-Poulenc, Inc.), 0.5 grams per liter of trisodium phosphate, and 0.25 grams per liter of Versene™ (Ethylenediaminetetraacetic acid, disodium salt; sequestering agent) from Mallinckrodt Specialty Chemicals Co. in Paris, KY and 0.0246% Tectilon® Orange from Ciba (diazo), 0.0258% Tectilon® Red 2B 200N from Ciba (monoazo), and 0.0285% Telon™ Blue BRL from Mobay (anthraquinone). The dye bath pH is adjusted to 6.0 with acetic acid. Yarn samples are placed into beakers and beakers into the Launder-Ometer where they are heated to 95° C. over 30 to 45 minutes and held at 95° C. for 30 minutes. Samples are cooled to approximately 40° C. and removed. The yarns are then rinsed with warm, then cold water and extracted in a residential washing machine. The yarns are then tumble dried in a residential dryer.

After dyeing the yarns were treated with BASF stain protector. Before the treatment, the dyed nylon yarns were scoured, rinsed extracted and tumble dried.

Exhaust application of stain protector

Samples are treated at a volume equal to 20 times the weight of sample. The stain protector bath is prepared using deionized water with 0.25 grams per liter of Versene™ (Ethylenediaminetetraacetic acid, disodium salt; sequestering agent) from Mallinckrodt Specialty Chemicals Co. in Paris, KY. and 0.9% BASF stain protector, which is a reaction product of the polymerization of methacrylic acid in the presence of a sulfonated aromatic formaldehyde condensation product, on the weight of fiber by weight of fiber (BASF stain protector). The pH of the solution is adjusted to 2.0 by using sulfamic acid. Yarns samples are treated in the bath at 85° C. for 15 minutes. After tumble drying, they are heated in an oven at 140° C. for one minute.

Shampooing of stain protector treated nylon carpet yarns

Shampoo solution (Bane-Clene TM PCA Formula no. 5 Bane-Clene Corp) is prepared according to directions on the container at room temperature. Each sample is treated in the shampoos in a 10:1 bath ratio for 30 minutes. The spin cycle of the washing machine is used to centrifuge the samples. Samples are air dried for at least 16 hours on screens.

Stain test procedure with C. I. Food Red 17

A Sauer's Red Food Color (Colour Index Food Red 17 or FD&C Red 40) from C. F. Sauer Company in Richmond, VA solution is prepared at 2.5 grams per liter concentration and adjusted to pH 2.8 with citric acid. Knitted tube sample is placed in a 10 to 1 bath ratio of food red 17 for 5 minutes at room temperature. After five minutes, the sample is removed from the bath and squeezed slightly. The sample is dried on screens at least 16 hours. Then, the sample is rinsed under running faucet of cold water until no more color is removed. The sample is centrifuged and tumble dried.

Results of testing of grey shade yarns are listed in Table II. FR-17 stands for the sample treated with Food Red 17 without Bane-Clene Shampooing. BCF-1 stands for the sample that has been Bane-Clene shampooed once and tested with Food Red 17 stain. BCP-2 stands for the sample has been Bane-Clene shampooed twice and tested with Food Red 17 stain.

TABLE II

| | Delta E (ΔE) Values for the Samples Before and After Shampooing | | |
|---|---|---|---|
| Test No. | Without Shampooing FR-17 | Once Shampooed BCP-1 | Twice Shampooed BCP-2 |
| 1 (control) | 0.72 | 9.30 | 11.82 |
| 2 | 1.11 | 3.27 | 8.09 |
| 3 | 0.34 | 2.39 | 6.33 |
| 4 | 1.44 | 1.76 | 4.67 |
| 5 | 0.47 | 1.24 | 3.67 |
| 6 | 0.28 | 0.94 | 3.19 |

I claim:

1. A process for the manufacture of a stain resistant carpet which retains its stain-resistance after shampooing, said process comprising the steps of:

a) melt-mixing (i) a fiber-forming synthetic polyamide having amino end groups with (ii) a compound which is capable of reacting with the amino end groups of said synthetic polyamide for a time and under conditions sufficient to cause said compound to react with the amino end groups of said synthetic polyamide to thereby form a homogenous polymer melt having an amino end group content of less than about 30 meg/kg;

b) spinning the polymer melt obtained in step a) into fibers;

c) tufting the fibers obtained according to step b) into a backing to form a carpet; and thereafter d) treating the carpet with a stain-resistant compound, selected from the group consisting of polymethacrylic acid, copolymers of polymethacrylic acid, a mixture of polymethacrylic acid and a sulfonated aromatic formaldehyde condensation product, and a reaction product of the polymerization or copolymerization of a methacrylic acid in the presence of a sulfonated aromatic formaldehyde condensation product.

2. The process according to claim 1, further comprising a drawing and texturing step after spinning step (b).

3. The process according to claim 2, further comprising a dyeing step after the drawing and texturing step.

4. The process according to claim 3, wherein the dyeing step is preformed with dyes, selected from the group consisting of acid dyes, disperse dyes, premetallized dyes and cationic dyes.

5. The process according to claim 1, further comprising coating the backing with a latex after step (d).

6. The process according to claim 5, further comprising applying a secondary backing on the latex.

7. The process according to claim 1, wherein the fiber forming polyamide is selected from the group consisting of nylon 6/6, nylon 6/9, nylon 6/10, nylon 6/12, nylon 6T, nylon 11, nylon 12, copolymers thereof and mixtures thereof.

8. The process according to claim 2, wherein the polyamide is nylon 6 or nylon 6/6.

9. The process according to claim 1, wherein the compound capable of reacting with the amino end groups of said synthetic polyamide, is selected from the group consisting of lactams, carboxylic acids, anhydrides, acid halogenates, lactones, esters and amides and mixtures thereof.

10. The process according to claim 1, wherein the compound which is capable of reacting with the amino end groups of said synthetic polyamide in step a) is present in an amount of from about 0.5 to about 5% by weight, based on the total amount of the polyamide fiber.

11. The process according to claim 1, wherein the copolymers of polymethacrylic acid are formed by copolymerization of methacrylic acid and monomers selected from the group consisting of monoolefinically unsaturated acids, esters anhydrides and amides.

12. The process according to claim 1, wherein the stain-resistant compound is a copolymer of polymethacrylic acid which includes units derived from at least one monomer selected from the group consisting of acrylic acid, maleic acid, maleic anhydride, fumaric acid, alkyl acrylate, cycloalkylacrylate, hydroxyalkylacrylate, acrylamide and methacrylamide.

13. The process according to claim 1, wherein the sulfonated aromatic formaldehyde condensation product comprise condensation products of formaldehyde with sulfonate aromatic compound selected from the group consisting of 4,4'-dihydroxydiphenylsulfone, phenyl-4-sulfonic acid and mixtures thereof.

14. The process according to claim 1, wherein the carpet is treated with an aqueous solution of the stain-resistant compound in step (d).

15. The process according to claim 14, wherein the aqueous solution has a solid content of from about 0.1 to about 10.0% by weight.

16. The process according to claim 1, wherein in step (d) an exhaust application is used for the treatment of the carpet.

17. The process according to claim 1, wherein in step (d) a continuous application is used for the treatment of the carpet.

18. The process according to claim 1, wherein in step (d) a foam application is used for the treatment of the carpet.

19. A stain resistant carpet, obtained by the process of claim 1.

20. The process according to claim 1, wherein the compound which is capable of reacting with the amino end groups of said synthetic polyamide is an $\alpha,\beta$-unsaturated carboxylic acid.

* * * * *